US005547392A

United States Patent [19]

Cheng et al.

[11] Patent Number: 5,547,392

[45] Date of Patent: Aug. 20, 1996

[54] STRUCTURE OF LAMP SOCKET

[76] Inventors: You-Jen Cheng; Tzu-Ling Cheng, both of P.O. Box 82-144, Taipei, Taiwan

[21] Appl. No.: 363,244

[22] Filed: Dec. 23, 1994

[51] Int. Cl.[6] ..... H01R 4/24

[52] U.S. Cl. ..... 439/419; 439/666; 439/752

[58] Field of Search ..... 439/395, 404, 439/417–419, 426, 666, 752

[56] References Cited

U.S. PATENT DOCUMENTS 2,360,444 10/1944 Pollock ..... 439/419
2,570,751 10/1951 Benander ..... 439/419
3,214,724 10/1965 McIntosh ..... 439/419
5,439,389 8/1995 Cheng et al. ..... 439/419

*Primary Examiner*—David L. Pirlot
*Attorney, Agent, or Firm*—Alfred Lei

[57] ABSTRACT

A lamp socket in which the socket body is formed of two symmetrical halves, having opposite inside flanges transversely disposed at the top, which hold two opposite ends of the positive contact metal plate, and an inside receptacle, which holds the bottom end of the negative contact metal plate, the two symmetrical halves of the socket body having opposite longitudinal ribs of substantially triangular cross section, respectively fastened together by two fastening blocks through dovetail joints to securely hold the two symmetrical halves matched.

1 Claim, 3 Drawing Sheets

STRUCTURE OF LAMP SOCKET

BACKGROUND OF THE INVENTION

The present invention relates to an improved structure of lamp socket which has means to protect the positive and negative contact metal plates against outward pulling force.

A lamp socket generally comprises a positive contact metal plate and a negative contact metal plate for connecting the tip and ring contacts of the lamp bulb to the electric wire to form a close circuit. The positive contact metal plate is made from metal plate by punching, having a plug portion inserted into a mounting groove on the top of the socket body, a triangular tip pierced the insulator of the electric wire to make an electric contact, and a curved contact portion fitted into a through hole on the top of the socket body for the contact of the tip contact of the lamp bulb. The negative contact metal plate is an elongated metal plate having a pointed tip extended out of a hole on the top of the socket body and pierced the insulator of the electric wire to make an electric contact, and a bottom end vertically extended into the inside of the socket body for the contact of the ring contact of the lamp body. This structure of lamp socket is not safe in use and does not conform to the safety requirements of UL standards, because the positive and negative contact metal plates can be easily moved out of place by children by a lever after the lamp bulb was removed.

SUMMARY OF THE INVENTION

The present invention provides an improved structure of lamp socket which eliminates the aforesaid problem. According to one aspect of the present invention, the socket body comprises opposite inside flanges transversely disposed at the top, which hold two opposite ends of the positive contact metal plate, and an inside receptacle, which holds the bottom end of the negative contact metal plate. Therefore, the positive and negative contact metal plates will not be moved out of place. According to another aspect of the present invention, the socket body is formed of two symmetrical halves having opposite longitudinal ribs of substantially triangular cross section, which are fastened together by two fastening blocks through dovetail joints to securely hold the two symmetrical halves matched.

DETAILED DESCRIPTION OF THE PREFERRED EMBODIMENT

Figure 1:
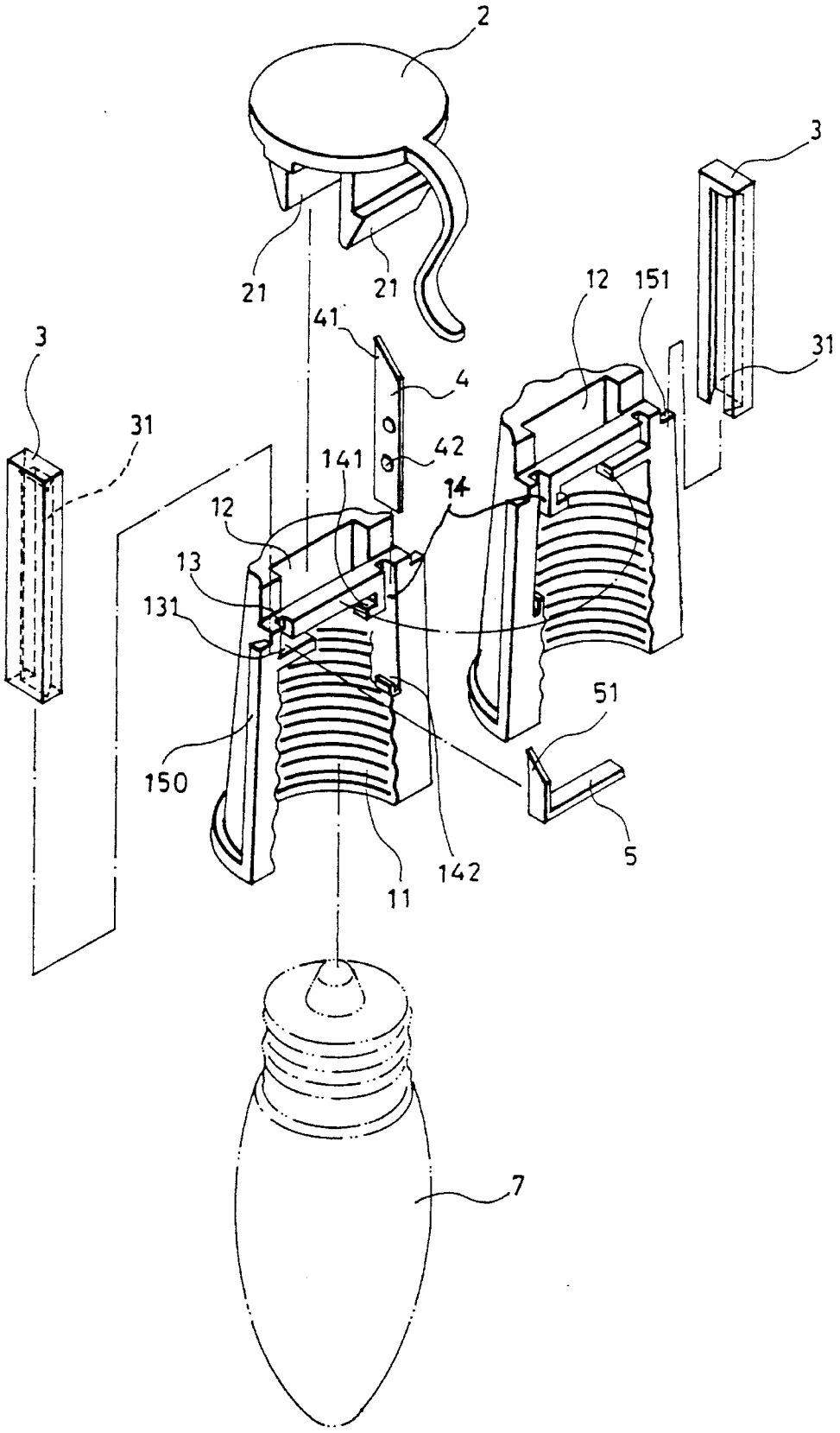
FIG. 1 is an exploded view of a lamp socket according to the present invention.

Referring to FIG. 1, a lamp socket in accordance with the present invention is generally comprised of a socket body 1, a socket cap 2, and a lamp bulb 7. The socket body 1 comprises a negative contact metal plate 4 longitudinally internally disposed at one side, and a positive contact metal plate 5 transversely internally disposed at the bottom. The socket body 1 further comprises two retaining holes 12 through the top thereof. The socket cap 2 comprises two downward hooks 21. By fastening the downward hooks 21 to the retaining holes 12, the socket cap 2 is securely connected to the socket body 1 to hold down the electric wire 6. Two slots 13 and 14 are made on the top of the socket body 1. The positive and negative contact metal plates 5 and 4 have a respective pointed tip 51 or 41 respectively extended out of the slots 13 and 14 and piercing the insulator of the electric wire 6 to make a respective electric contact. When the lamp screw base of the lamp bulb 7 is threaded into the inner thread 11 of the socket body 1, the tip and ring contacts of the lamp screw base of the lamp bulb 7 are respectively connected to the positive and negative contact metal plates 5 and 4 to close the circuit.

Figure 2:
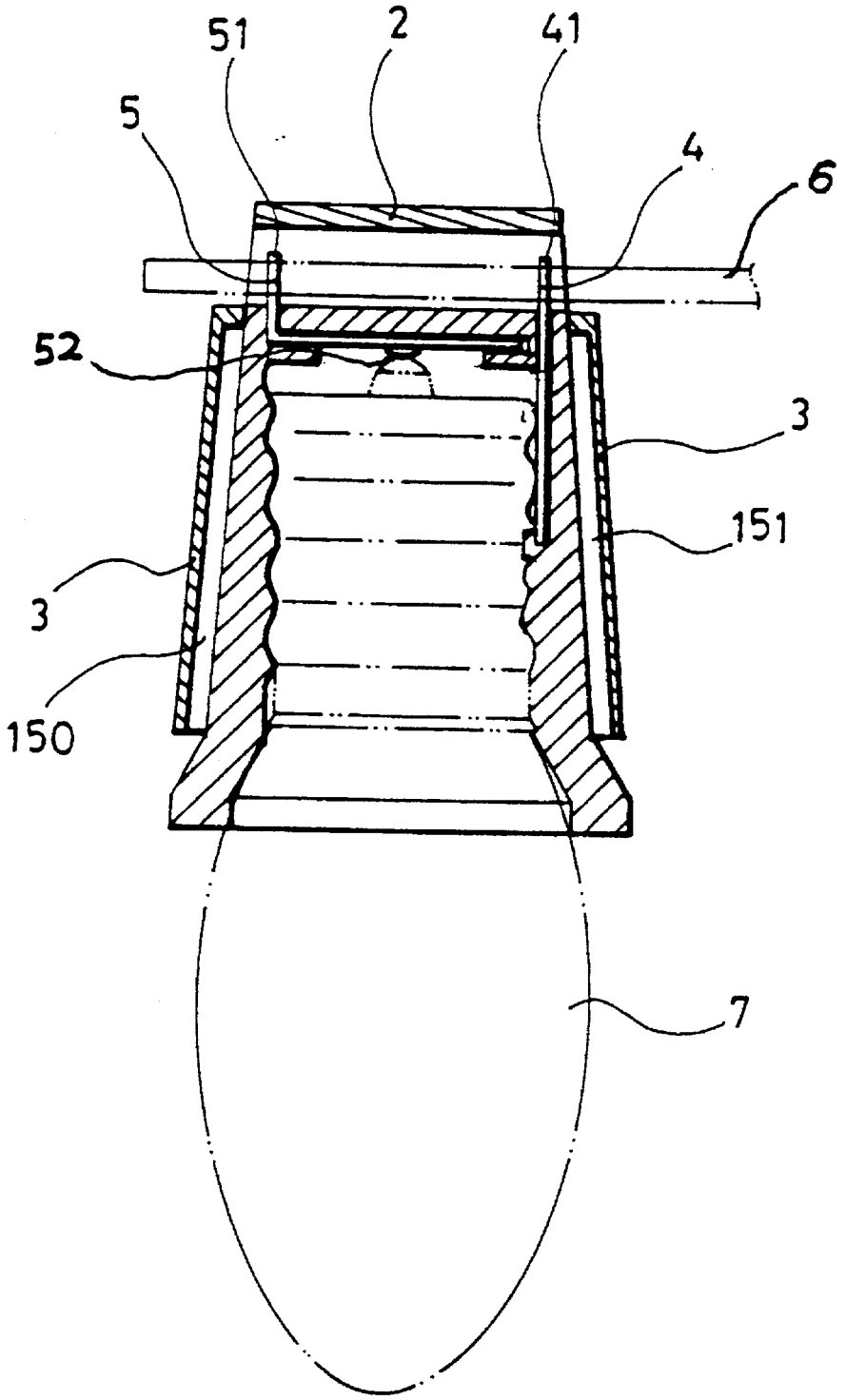
FIG. 2 is a longitudinal view in section of the lamp socket shown in FIG. 1.
Figure 3:
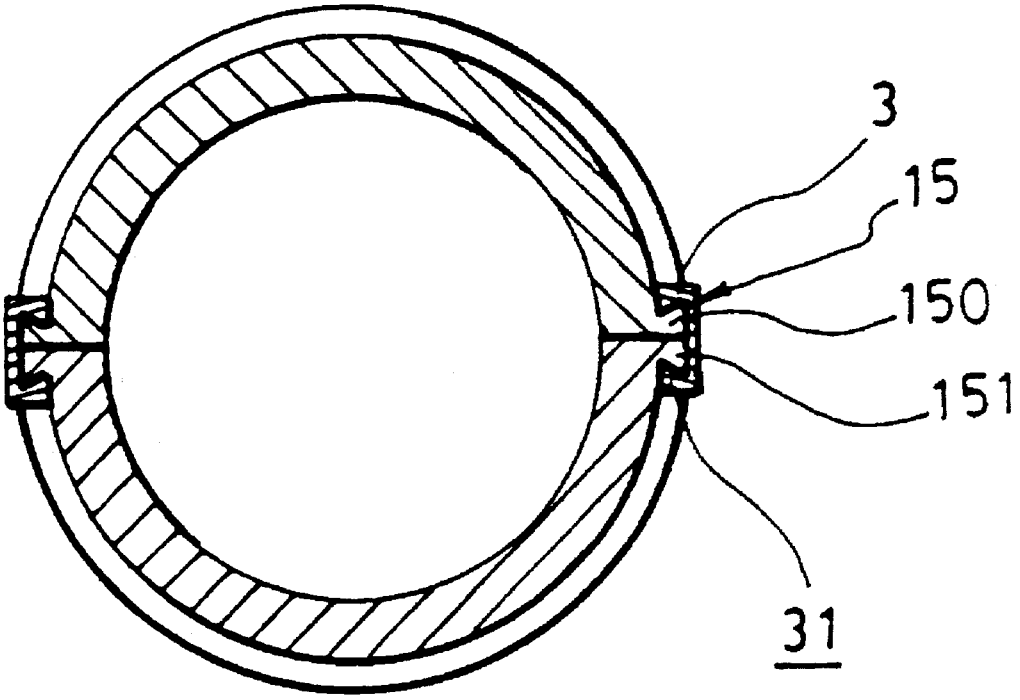
FIG. 3 is a transverse view in section of FIG. 2.

Referring to FIGS. 2 and 3 and FIG. 1 again, the socket body 1 is comprised of two symmetrical halves. Each half of the socket body 1 comprises one retaining hole 12, one half of the slot 13 and one half of the slot 14, a first inside flange 131 transversely disposed below the slot 13, a second inside flange 141 disposed opposite to the first inside flange 131, a receptacle 142 longitudinally disposed on the inside wall and spaced below the slot 14, two longitudinal ribs 150 and 151 of substantially triangular cross section bilaterally raised from the outside wall. When the two symmetrical halves of the socket body 1 are connected together, the longitudinal ribs 150 and 151 of the two symmetrical halves are matched together and form two dovetail tongues 15. The positive contact metal plate 5 is made of L-shape, having a raised contact portion 52 at the bottom. The negative contact metal plate 4 is a flat, elongated plate having a plurality of raised contact portions 42 at one side. There are also provided two fastening blocks 3 having a respective dovetail groove 31 for matching with one dovetail tongue 15. Before the two symmetrical halves of the socket body 1 are fastened together by the fastening blocks 3, the positive contact metal plate 5 is inserted into the space defined between the first inside flange 131 and the second inside flange 141, permitting the pointed tip 51 to extend out of the slot 13, and the negative contact metal plate 4 is inserted through the slot 14 into the receptacle 142. When the positive contact metal plate 5 and the negative contact metal plate 4 are installed in position, the two symmetrical halves of the socket body 1 are matched, and the fastening blocks 31 are respectively fastened to the dovetail tongues 15 to hold the two symmetrical halves of the socket body 1 together. When the socket body 1 is assembled, the electric wire 6 is placed on the wire groove on the top of the socket body 1, and then the socket cap 2 is fastened to the socket body 1 to hold down the electric wire 6, by hooking the downward hooks 21 into the retaining holes 12, causing the pointed tips 51 and 41 of the positive and negative contact metal plates 5 and 4 respectively pierced the insulator of the electric wire 6 to make a respective electric contact. Because the positive contact metal plate 5 is supported between the first and second inside flanges 131 and 141 and the bottom end of the negative contact metal plate 4 is received in the receptacle 142, the positive and negative contact metal plates 5 and 4 cannot be moved out of place by a lever or the like. The only way to move the positive and negative contact metal plates 5 and 4 is to disconnect the fastening blocks 3 from the dovetail tongues 15 and then to separate the two symmetrical halves of the socket body 1. Therefore, this structure of lamp socket is safe in use.

What is claimed is:

1. A lamp socket comprising a socket body having a positive contact metal plate and a negative contact metal plate securely fixed on inside thereof, and a socket cap fastened to said socket body, and an electric wire retained between said socket body and said socket cap, wherein:

said socket body is comprised of two symmetrical halves fastened together by two fastening blocks, each half comprising a first slot, a first inside flange transversely disposed below said first slot, a second inside flange disposed opposite to said first inside flange, a second slot, a receptacle disposed below said second slot, two longitudinal ribs of substantially triangular cross section bilaterally disposed on the outside, said fastening blocks having a respective dovetail groove, which receives one longitudinal rib of each half of said socket body;

said positive contact metal plate has one end transversely supported between said first and second inside flanges, and an opposite end extended out of said first slot and piercing the insulation of said electric wire to make an electric contact, the transverse end of said positive contact metal plate which is supported between said first and second inside flanges having a raised contact portion extended out of said first and second inside flanges for the contact of a tip contact of the lamp bulb;

said negative contact metal plate has a bottom end inserted into said receptacle, a top end extended out of said second slot and piercing the insulation of said electric wire to make an electric contact, and a plurality of raised contact portions vertically spaced at an outer side thereof for contacting a ring contact of a lamp bulb.

* * * * *